US006718650B2

(12) United States Patent
Ross

(10) Patent No.: US 6,718,650 B2
(45) Date of Patent: Apr. 13, 2004

(54) PERSONAL DRYER

(76) Inventor: Sherry Ross, 1047 Rockcrest Dr., Marietta, GA (US) 30062

( * ) Notice: Subject to any disclaimer, the term of this patent is extended or adjusted under 35 U.S.C. 154(b) by 20 days.

(21) Appl. No.: 10/175,734

(22) Filed: Jun. 20, 2002

(65) Prior Publication Data

US 2003/0234100 A1 Dec. 25, 2003

(51) Int. Cl.[7] ..... F26B 19/00

(52) U.S. Cl. ..... 34/90; 392/380; 236/94; 236/13

(58) Field of Search ..... 34/96, 93, 72, 34/90, 73; 62/93, 186; 236/94, 13; 392/380

(56) References Cited

U.S. PATENT DOCUMENTS

| | | | | |
|---|---|---|---|---|
| 3,449,838 A | | 6/1969 | Chancellor, Jr. | |
| 3,621,199 A | | 11/1971 | Goldstein | |
| 3,878,621 A | | 4/1975 | Duerre | |
| 4,558,526 A | | 12/1985 | Baus | |
| 4,780,595 A | | 10/1988 | Alban | |
| 4,857,705 A | | 8/1989 | Blevins | |
| 4,961,272 A | | 10/1990 | Lee | |
| 5,007,182 A | | 4/1991 | Fishman et al. | |
| 5,099,587 A | | 3/1992 | Jarosch | |
| 5,103,577 A | | 4/1992 | Michaels et al. | |
| 5,269,071 A | | 12/1993 | Hamabe et al. | |
| 5,377,424 A | | 1/1995 | Albanes | |
| 5,394,620 A | | 3/1995 | Chimera | |
| 5,418,561 A | * | 5/1995 | Fujioka | 347/88 |
| 5,651,189 A | | 7/1997 | Coykendall et al. | |
| 5,752,326 A | | 5/1998 | Trim | |
| 5,873,179 A | | 2/1999 | Gregory et al. | |
| 5,893,218 A | * | 4/1999 | Hunter et al. | 34/492 |
| 5,930,912 A | | 8/1999 | Carder | |
| 6,131,303 A | | 10/2000 | Roper | |
| 6,148,539 A | | 11/2000 | Hatfield et al. | |
| 6,349,484 B1 | | 2/2002 | Cohen | |

* cited by examiner

*Primary Examiner*—Harry B. Tanner
*Assistant Examiner*—Camtu Nguyen
(74) *Attorney, Agent, or Firm*—Myers & Kaplan, LLC; Joel D. Myers; Ashish D. Patel

(57) ABSTRACT

A personal dryer capable of expelling temperatured air uniformly throughout the dryer and/or different temperatured air at different regions of the dryer, so as to provide a user with the option of drying their entire body with a more desirable uniformly temperatured air and/or drying different bodily regions with different or varied, user-selectable temperatured air, and wherein such a personal dryer is capable of being pre-programmed to enable a user to dry his/her body in a user-specified regimen or manner.

9 Claims, 6 Drawing Sheets

PERSONAL DRYER

TECHNICAL FIELD

The present invention relates generally to dryers, and more specifically to a personal dryer. The present invention is particularly suitable for, although not strictly limited to, assisting in the evaporative removal and drying of moisture from one's body.

BACKGROUND OF THE INVENTION

Typically, after exposure to a bath, shower, swimming pool or the like, water-soaked individuals often turn to conventional towel drying techniques in attempts to remove water and/or excess moisture from their body. Although towel drying is an effective method of removing and drying moisture from one's body, daily utilization of towels has its obvious and apparent disadvantages.

In general, most individuals only have a finite amount of towels available for use. As such, most individuals are often forced to re-use a towel used earlier in the day, or even from the previous day, to dry their body. Such re-use of towels can be unhygienic via the reapplication of dirty body oils, body hair and/or dead skin cells trapped in the towel from previous use. Moreover, towels, in general, are an inconvenience, as they have a tendency of adding to the usual washroom clutter, often ending up on the floor in an unsightly pile.

Additionally, individuals inflicted with painful body sores, rashes and/or other skin inflammations may find it extremely uncomfortable and/or impossible to utilize towels to dry their body, as towel use in such conditions often exacerbates an already distressed skin condition.

Some individuals, specifically paraplegics, quadriplegics and/or the sick and elderly, may find it difficult, if not impossible, to dry their own body due to their disabilities and the inherent limitations associated therewith. As such, physically disabled individuals must often depend upon an assistant to aid in basic body drying needs, an often expensive and potentially awkward and embarrassing situation.

A common resolution for those wishing to avoid regular towel use has been utilization of a hairdryer to dry their body. Unfortunately, utilizing a hairdryer to dry one's body is usually a highly inefficient and ineffective technique that can potentially subject the user to bodily burns resulting from the high-temperature air expelled from conventional hairdryers.

Although attempts have been made to alleviate the dependency and/or use of towels via the development of body-sized dryers, such attempts have been unsuccessful due to the intrinsic disadvantages associated therewith. Specifically, many prior art body/personal dryers fail to blow dry air. Instead, many prior art dryers are limited to blowing out moist heated air. As such, users are essentially drying themselves with the equivalent of a body-sized hairdryer, wherein undesirable moist heated air can cause the user to sweat and thus, defeat the overall purpose of the cleansing and drying process.

Most prior-art dryers are further disadvantaged, as they are incapable of enabling a user to select a desired temperature for expelled dry air and are, additionally, unable to dispense variable temperatured air through different regions of the device. Thus, users of such devices are forced to dry themselves at a preset and uniform temperature, rather than having the option of drying their entire body at a more desirable personally selected temperature and/or drying different bodily regions with different, user-variable temperatured air.

Therefore, it is readily apparent that there is a need for a personal dryer that alleviates conventional towel use, wherein such a personal dryer is embeddable within a wall and is capable of expelling uniformly temperatured air and/or variable temperatured air from different regions of the dryer, so as to provide a user with the option of drying the entire body with a personally selected uniform temperatured air and/or drying different bodily regions with different or varied, user-selectable temperatured air, and wherein such a personal dryer is capable of being pre-programmed to enable a user to dry his/her body following a user-specified regimen or manner.

BRIEF SUMMARY OF THE INVENTION

Briefly described, in a preferred embodiment, the present invention overcomes the above-mentioned disadvantages and meets the recognized need for such a device by providing a personal dryer that alleviates conventional towel use, wherein such a personal dryer is embeddable within a wall and is capable of expelling uniformly temperatured air and/or variable temperatured air from different regions of the dryer, so as to provide a user with the option of drying the entire body with a personally selected uniform temperatured air and/or drying different bodily regions with different or varied, user-selectable temperatured air, and wherein such a personal dryer is capable of being pre-programmed to enable a user to dry his/her body following a user-specified regimen or manner.

According to its major aspects and broadly stated, the present invention in its preferred form is a wall embeddable personal dryer having, in general, an air conditioning apparatus, pressure control valves, air volume control valves, mixing chamber, thermocouplers, manifold apparatus and control panel.

More specifically, the present invention is a personal dryer capable of mixing cooled dry air with heated dry air to achieve a user-selected temperature and to generate a flow of said air for application to the user's body, the personal dryer having an air conditioning apparatus, wherein the air conditioning apparatus is preferably a compressor with refrigerated dryer, and wherein the compressor with refrigerated dryer is preferably activated via the control panel to generate a user-selectable uniform temperatured air. The cooled, dry and uniform temperatured air generated by the compressor with refrigerated dryer is preferably channeled through a series of tubing for subsequent pressure manipulation via a pressure control valve, wherein user-selected parameters for uniform temperatured air preferably determines the amount of air released by the pressure control valve for introduction into a mixing chamber. An air volume control valve preferably functions to introduce high-temperatured air generated and channeled from a segmented condenser coil of the compressor to a mixing chamber to mix with the air released therein via the pressure control valve. The user-selected uniform temperatured air preferably determines the volume of air distributed/released by the air volume control valve and the pressure control valve, respectively, into the mixing chamber for subsequent expelling of the same via ports formed in the manifold apparatus.

To establish different temperatured air for passage through different ports, each port preferably possesses an air volume control valve that is preferably computer controlled/manipulated via the control panel and is preferably in direct communication with the segmented condenser coil via tubing, wherein unmixed high temperatured air produced by the segmented condenser coil is channeled through the tubing for passage through the ports at a volume regulated by the computer controlled air volume control valves. The volume of air that is permitted to pass through the air volume control valve of a specific port is primarily a function of the user-selected temperature at that port, wherein the volume of expelled air preferably mixes with the air channeled from the mixing chamber to generate/establish the user-selected variable temperatured air at that specific port. To ensure that accurately temperatured air is being expelled via each port, a thermocoupler is provided for each port, wherein each thermocoupler is preferably in electronic feedback communication with the control panel so as to maintain accurate computer control/monitoring of the air temperature at each port.

The control panel further preferably possesses pre-programmable/pre-set functions that enable a user to program and/or select a consistent, daily body drying program/regimen to best accommodate that user's particular personal drying desires, wherein the personal dryer can be pre-programmed to expel a uniform temperatured air and/or differently temperatured air past each port.

A feature and advantage of the present invention is its ability to be embedded within the wall of any residence, hotel, athletic and/or swimming facility, hospital, nursing home and/or any other building and/or dwelling where dry, user-selectable temperatured air is required/desired.

A feature and advantage of the present invention is its ability to be incorporated/installed in any residence, hotel, athletic and/or swimming facility, hospital, nursing home and/or any other building and/or dwelling where dry, user-selectable temperatured air is required/desired.

A feature and advantage of the present invention is its ability to produce dry, moisture-free air at any user-desired temperature.

A feature and advantage of the present invention is its ability to produce dry, moisture-free air at any user-desired temperature for drying the body of the user.

A feature and advantage of the present invention is its ability to produce dry, moisture-free air at any user-desired temperature for the drying of any article.

A feature and advantage of the present invention is its ability to be pre-programmed/pre-set via the control panel to expel a uniform temperatured air and/or variable temperatured air via each port to best accommodate the personal needs of the user.

A feature and advantage of the present invention is its ability to function as an air dehumidifier.

A feature and advantage of the present invention is it ability to be manufactured to any size.

A feature and advantage of the present invention is its ability to provide ports that expelling air in a multitude of directions via multi-directional and/or oscillating fan blades or louvers positioned on and/or proximal each port from which air is expelled.

A feature and advantage of the present invention is it ability to incorporate hair dryers and/or other hand-held drying tubes that will expel dry, moisture-free air.

A feature and advantage of the present invention is it ability to incorporate heating elements that provide an immediate heat zone/proximity prior to the ports expelling any air.

These and other objects, features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATIVE EMBODIMENTS

In describing the preferred and alternate embodiments of the present invention, as illustrated in FIGS. 1–6, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
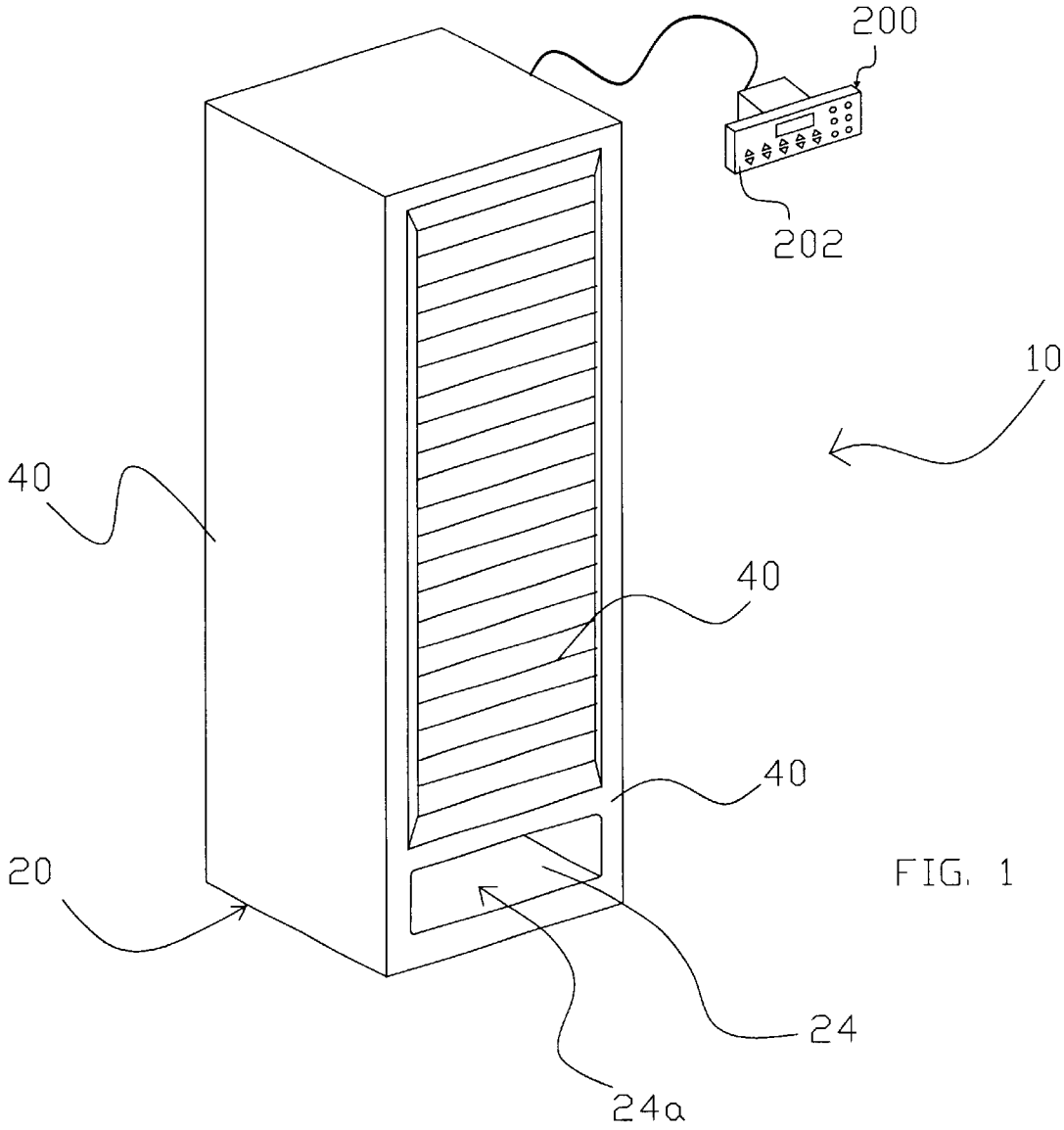
FIG. 1 is a perspective view of a personal dryer according to a preferred embodiment of the present invention.

Referring now to FIG. 1, the present invention in its preferred embodiment is a device 10, wherein device 10 is a personal dryer capable of being embedded within a wall, and wherein device 10 possesses in general housing 20, internal dryer assembly 40 and control panel assembly 200.

Specifically, internal dryer assembly 40 is enclosed substantially within housing 20, wherein housing 20 preferably possesses protective grill 22 positioned on front surface 20*a* of housing assembly 20, and wherein protective grill 22 preferably serves to shield a user of device 10 from the high-energy and/or heating components of internal dryer assembly 40, as more fully described below. Housing 20 and protective grill 22 are preferably formed from a heat-resistant and/or non-heat conductive material so as to prevent the injury/burning of a user should the user's body come into contact with housing 20 and/or protective grill 22. Preferably, housing 20 is dimensioned to accommodate the body height of an average adult human and preferably dimensioned to accommodate the body width of an average adult human; although housing 20, could be manufactured to any size, height and/or width. Furthermore, the depth of housing 20 is preferably dimensioned to permit full recession of housing 20, and enclosed internal dryer assembly 40, within a wall, such that front face 20*a* of housing 20 preferably sits flush with the wall surface. Upon installation of housing 20 within a wall, graphical user interface 202 of control panel assembly 200 also preferably sits flush with the wall surface, wherein control panel assembly 200 preferably functions to permit computer control of internal dryer assembly 40 for subsequent expelling of dry air past protective grill 22 at user-specified temperatures, as more fully described below. While full recession of housing 20 within a wall is preferred, one skilled in the art would readily recognize that alternate installations could be utilized, such as, for exemplary purposes only, partial recession into a wall, or surface mounting on a wall, or stand alone use could be utilized, wherein housing 20 could be floor or table supported or could incorporate a stand.

Preferably formed on front surface 20*a* of housing 20, preferably just beneath protective grill 22, is intake port 24, wherein intake port 24 is preferably an aperture 24*a* that extends through front face 20*a* of housing 20 and preferably communicates with internal dryer assembly 40 so as to supply air thereto for subsequent manipulation and expelling of the same past protective grill 22, as more fully described below. Although the preferred location of intake port 24 is below protective grill 22 of housing 20, it is contemplated in an alternate embodiment that intake port 24 could be positioned in any other suitable area on housing 20 and/or positioned apart therefrom in any suitable manner that would permit the introduction of air into and through internal dryer assembly 40 of device 10.

Figure 2:
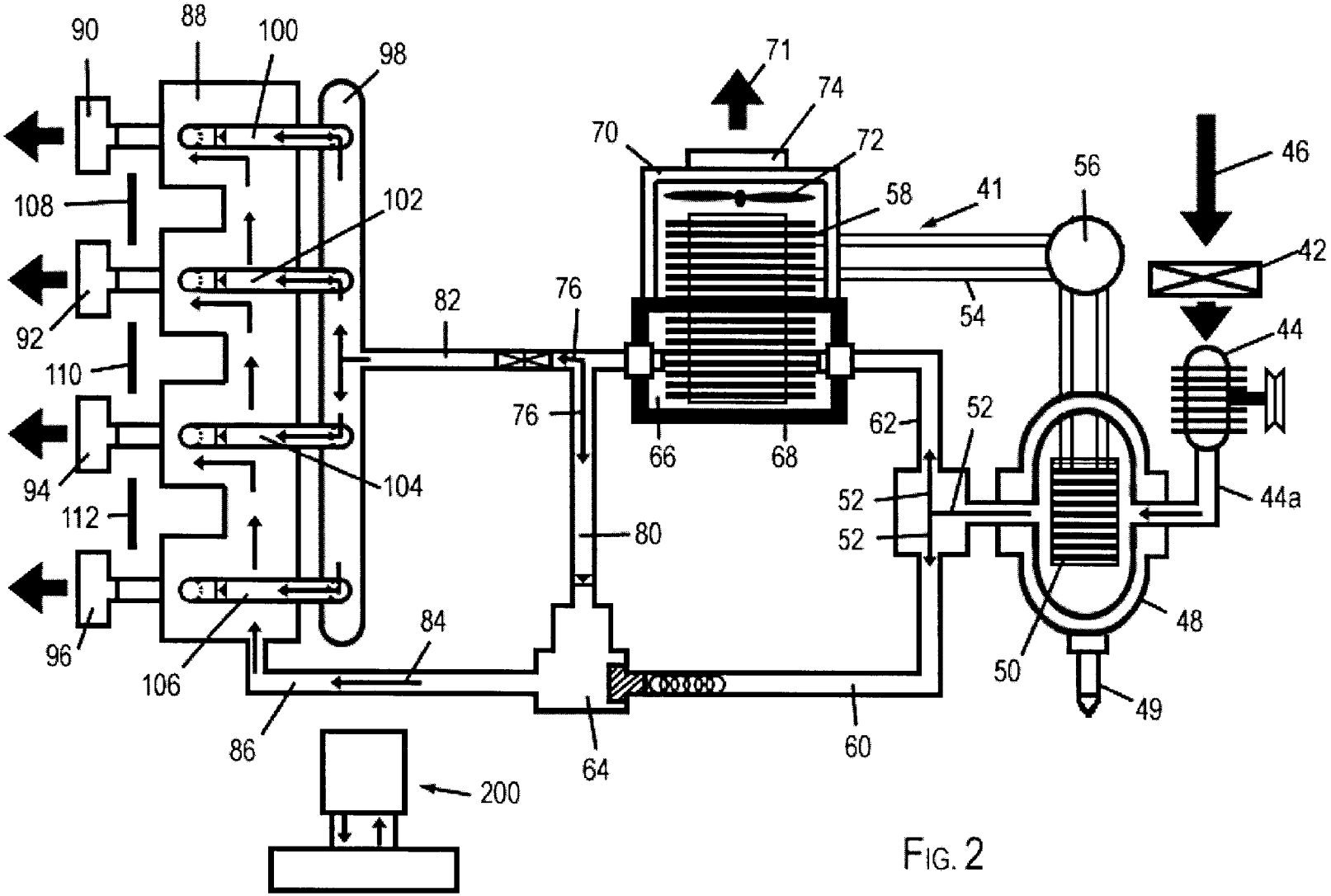
FIG. 2 is a schematic view of the internal dryer assembly of a personal dryer according to a preferred embodiment of the present invention.
Figure 3:
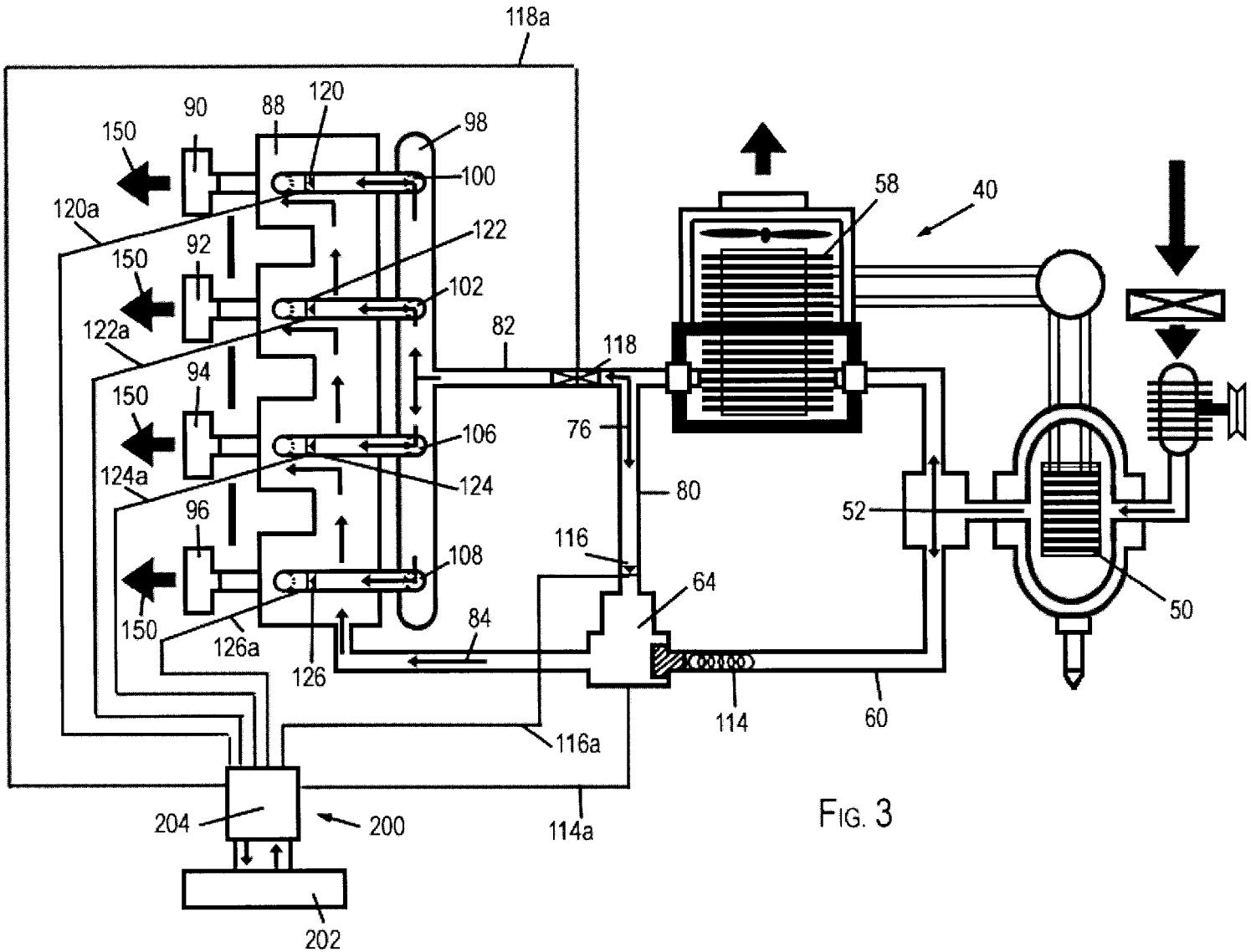
FIG. 3 is a schematic view of the internal dryer assembly of a personal dryer according to a preferred embodiment of the present invention.
Figure 4:
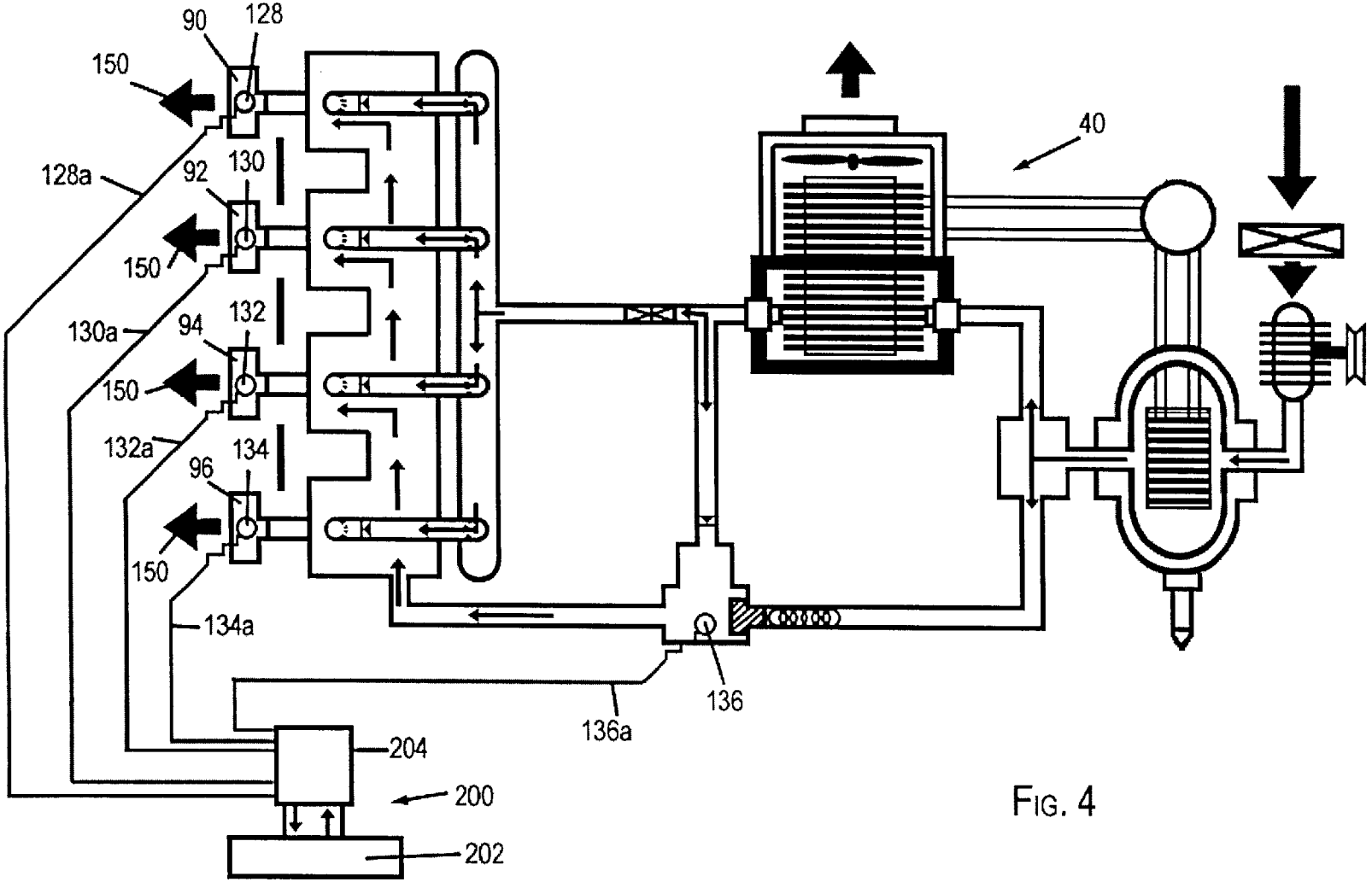
FIG. 4 is a schematic view of the internal dryer assembly of a personal dryer according to a preferred embodiment of the present invention.

Referring now to FIGS. 2–4, schematic representations of internal dryer assembly 40 are illustrated therein, wherein internal dryer assembly 40 is preferably dimensioned to fit substantially within housing 20, as more fully described below. Specifically, disposed preferably proximal to intake port 24 of housing 20 is air filter 42, wherein air filter 42 preferably functions to filter air drawn through intake port 24 before complete introduction of the air through internal dryer assembly 40, and wherein air filter 42 is preferably any suitable air filter known within the art, such as, for exemplary purposes only, an electrostatic filter, HEPA filter and/or UV sterilizer.

Preferably proximal to air filter 42 is compressor 44 of air conditioning apparatus 41, wherein air conditioning apparatus 41 is preferably compressor 44 with a refrigerated dryer as known within the art; although other suitable known air conditioning technologies may also be utilized to collectively and effectively impart the preferred dry-air-producing system of device 10. Specifically, compressor 44 preferably draws airflow 46 through intake port 24 and air filter 42 and into pressure tank 48 via tubing 44*a* for subsequent introduction of airflow 46 through evaporative coil 50. Once introduced past evaporative coil 50, airflow 46 is converted to cooled, primary dry air 52 via assistance from refrigerant tubing 54, secondary compressor 56 and condenser coil 58 as known within the art. Condensation is preferably relieved from pressure tank 48 via condensation drain 49, wherein the drawn off water is preferably captured/maintained in a drain pan removable from device 10 and/or drawn off and directed into local plumbing facilities and/or removed in any other suitable manner known within the art.

Preferably leading from pressure tank 48 are tubes 60 and 62, wherein tubes 60 and 62 are preferably flexible and/or pliable so as to allow manipulation and fitting of internal dryer assembly 40 within housing 20 of device 10. Tube 60 preferably channels cooled primary dry air 52 produced by evaporative coil 50 to mixing chamber 64 for subsequent temperature manipulation thereof, as more fully described below. Tube 62 preferably channels cooled primary dry air 52 produced by evaporative coil 50 to condenser coil 58 for subsequent temperature manipulation thereof, as more fully described below.

Condenser coil 58 is preferably a segmented condenser coil as known within the art, preferably possessing compartmentalized or segmented region 66, wherein segmented region 66 is preferably enclosed within compartment 68, and wherein the remainder of condenser coil 58 is enclosed within housing 70. During conventional air conditioning processes, the condenser coil must release heat and/or heated air. As such, housing 70 preferably possesses ventilation fan 72 and ventilation aperture 74 for venting excess heat and heated air produced/released by condenser coil 58 (as indicated by arrow 71 in FIG. 2) to the outside/exterior of the building/dwelling/facility in which device 10 has been installed. Housing 70 is preferably disposed/situated on the exterior of the building/dwelling/facility in which device 10 has been installed. It is contemplated in an alternate embodiment that ventilation aperture 74 of housing 70 could be attached/connected to pre-existing duct work to direct heat out and away from the portion of condenser coil 58 enclosed within housing 70; or, via any other suitable ventilation means known within the art.

Tube 62 preferably leads into segmented region 66 of condenser coil 58, wherein primary dry air 52 is preferably channeled therethrough and intermixed with the heated air produced by condenser coil 58 during formation of primary dry air 52, thus resulting in the formation secondary dry air 76. Preferably, secondary dry air 76 is at a significantly higher temperature than primary dry air 52 so as to assist in the production of air having the uniform and/or varied temperature specified by the user, as more fully described below.

Secondary dry air 76 is preferably directed from segmented region 66 via tube 78, and therefrom into tubes 80 and 82, wherein tubes 80 and 82 are preferably flexible and/or pliable so as to allow manipulation and fitting of internal dryer assembly 40 within housing 20 of device 10. Preferably, tube 80 leads into mixing chamber 64 and directs secondary dry air 76 therein for the subsequent production of tertiary dry air 84, wherein tertiary dry air 84 is preferably a user-specified uniform temperatured air, as more fully described below. Tertiary dry air 84 is preferably channeled from mixing chamber 64 via tube 86 into common log manifold 88, wherein common log manifold 88 is preferably substantiality tube-like and preferably possesses exit ports 90, 92, 94 and 96 for the expelling therepast of tertiary dry air 84. Tube 86 is preferably flexible and/or pliable so as to allow manipulation and fitting of internal dryer assembly 40 within housing 20 of device 10.

When internal dryer assembly 40 is positioned within housing 20 of device 10, exit ports 90, 92, 94 and 96 are preferably positioned proximal to protective grill 22 of housing 20 and are preferably spout-like projections that channel tertiary dry air 84 therepast, as more fully described below. Furthermore, exit ports 90, 92, 94 and 96 preferably possess oscillating capabilities as known within the art, so as to permit the multi-directional blowing of dry air therepast; or, alternatively, could possess no oscillating functions, so as to permit only unidirectionally blown dry air. Furthermore, common log manifold 88 could possess as many ports as desired for the expelling of tertiary dry air 84 therepast, wherein the ports could also be positioned in any suitable manner.

Preferably, tube 82 leads to secondary manifold tube 98 for the conveyance of secondary dry air 76 therein, wherein secondary manifold tube 98 is preferably positioned behind common log manifold 88. Preferably extending from secondary manifold tube 98 and into common log manifold 88 are mixing tubes 100, 102, 104 and 106, wherein mixing tubes 100, 102, 104 and 106 are preferably in communication with exit ports 90, 92, 94 and 96, respectively, for the production and expelling of a variety of temperatured air therepast upon mixing with tertiary dry air 84, as more fully described below.

Preferably positioned between exit ports 90 and 92 is heating element 108. Similarly, preferably positioned between exit ports 92 and 94 is heating element 110; and between exit ports 94 and 96, heating element 112. Heating elements 108, 110 and 112 are preferably low-voltage/low-emittance heating elements that function primarily as proximity heaters to create a warm zone prior to the blowing of air past exits ports 90, 92, 94 and 96, wherein heating elements 108, 110 and 112 are preferably disposed behind protective grill 22 of housing 20 to shield a user of device 10 therefrom. Heating elements 108, 110 and 112 are preferably IR heating elements as known within the art; although, heating elements 108, 110 and 112 could be any other type of suitable heating element known within the art, such as, for exemplary purposes only, heating coils and/or other ceramic heating elements. Heating elements 108, 110 and 112 are preferably selectively activated/deactivated via buttons 218 on graphical user interface 202 of control panel assembly 200.

Figure 5:
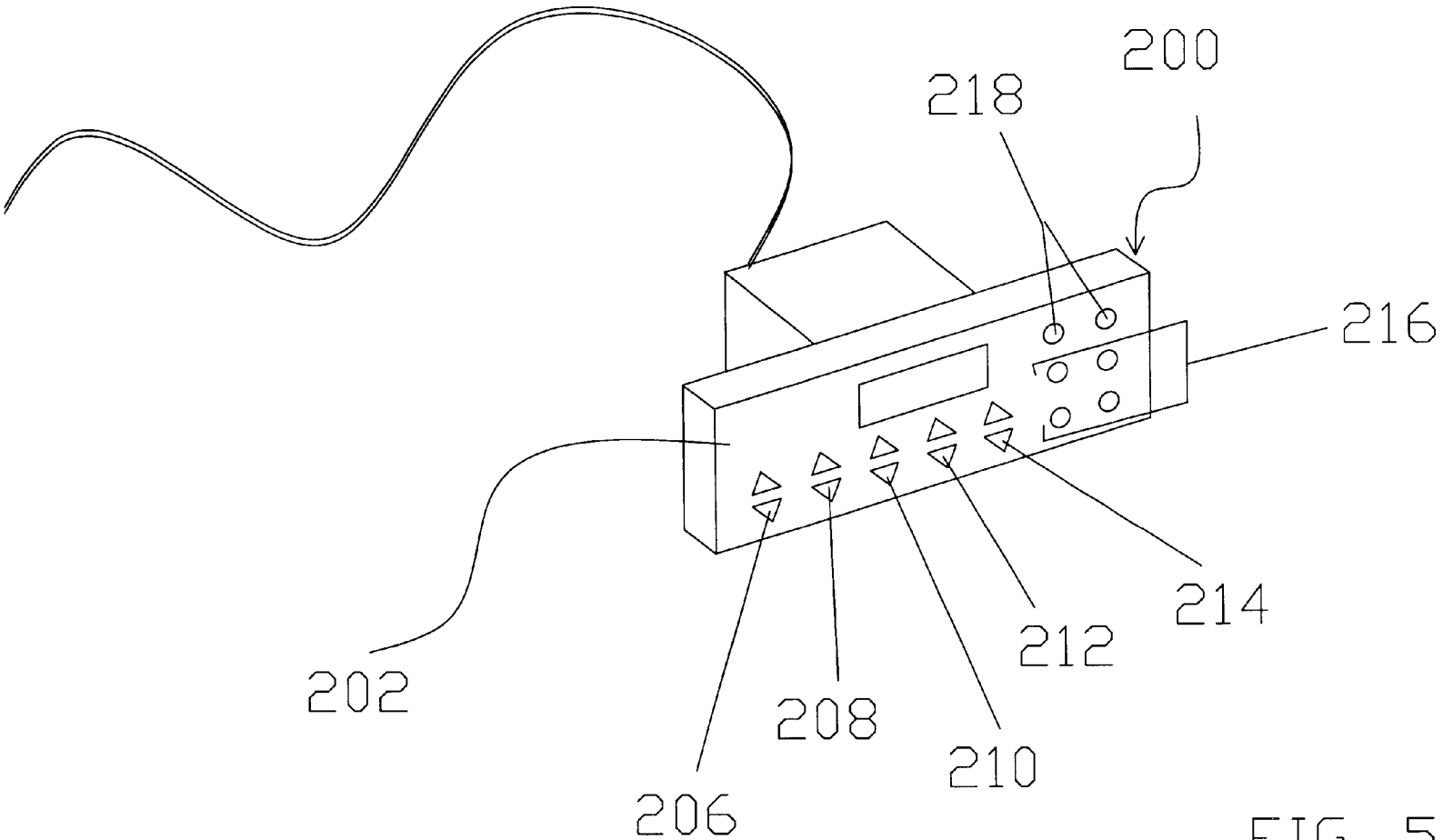
FIG. 5 is a perspective view of a control panel of the personal dryer according to a preferred embodiment of the present invention.

Referring specifically now to FIGS. 3–5, a description of the production of uniform and varied temperatured air follows. Preferably, primary dry air 52 is a uniform temperatured air expelled by evaporative coil 50 of air conditioning apparatus 41, having a uniform cool temperature, for example generally preferably at about 50 degrees Fahrenheit; although, it is contemplated that a different uniform temperatured air could be utilized and could be produced by other known air conditioning technologies. Similarly, secondary dry air 76 produced by condenser coil 58 is also preferably a uniform hot temperatured air, having a uniform temperature, for example generally preferably at about 140 degrees Fahrenheit; although, it is contemplated that other temperatures could be utilized as could other air conditioning technologies.

Additionally, preferably positioned within tube 60 is first pressure control valve 114, wherein first pressure control valve 114 is any suitable air pressure control valve known within the art, and wherein first pressure control valve 114 is preferably in computer/electronic communication with control box 204 of control panel assembly 200 preferably via wire 114*a*. Preferably positioned within tube 80 is first air volume control valve 116, wherein first air volume control valve 116 is any suitable air volume control valve known within the art, and wherein first air volume control valve 116 is preferably in computer/electronic communication with control box 204 of control panel assembly 200 preferably via wire 116*a*.

As such, for exemplary purposes, if a user of device 10 wishes to have a uniform temperatured air set at 80 degrees Fahrenheit expelled past exits ports 90, 92, 94 and 96, the user preferably utilizes first button set 206 on graphical user interface 202, as depicted in FIG. 5, to cue in the desired 80 degrees Fahrenheit uniform temperature, wherein the selected temperature is digitally displayed on digital interface 250. Thereafter, control box 204 preferably activates first pressure control valve 114 and first air volume control valve 116 preferably via wires 114*a* and 116*a*, respectively, to open and release into mixing chamber 64 the appropriate fractional amounts of primary dry air 52 and secondary dry air 76, respectively, to produce the desired 80 degrees Fahrenheit uniform temperatured tertiary dry air 84 for subsequent introduction into common log manifold 88 and conveyance past exits ports 90, 92, 94 and 96 as resulting air 150. In such a configuration, a user can have essentially any uniform temperatured tertiary dry air 84 produced and expelled.

Preferably positioned within tube 82 is second pressure control valve 118, wherein second pressure control valve 118 is any suitable air pressure control valve known within the art, and wherein second pressure control valve 118 is preferably in computer/electronic communication with control box 204 of control panel assembly 200 preferably via wire 118*a*. Preferably positioned within mixing tubes 100, 102, 104 and 106 of secondary manifold tube 98 is second air volume control valve 120, third air volume control valve 122, fourth air volume control valve 124 and fifth air volume control valve 126, wherein second air volume control valve 120, third air volume control valve 122, fourth air volume control valve 124 and fifth air volume control valve 126 are any suitable air volume control valves known within the art, and wherein second air volume control valve 120, third air volume control valve 122, fourth air volume control valve 124 and fifth air volume control valve 126 are preferably in computer/electronic communication with control box 204 of control panel assembly 200 preferably via wires 120*a*, 122*a*, 124*a* and 126*a*, respectively.

As such, for exemplary purposes, if a user of device 10 wishes to change the previously cued in uniform temperature setting to enable different temperatured airs set at; for example, 70 degrees Fahrenheit, 78 degrees Fahrenheit, 85 degrees Fahrenheit and 93 degrees Fahrenheit expelled via exits ports 90, 92, 94 and 96, respectively, the user preferably utilizes second button set 208, third button set 210, fourth button set 212 and fifth button set 214 on graphical user interface 202 to cue in the desired respective 70 degrees Fahrenheit, 78 degrees Fahrenheit, 85 degrees Fahrenheit and 93 degrees Fahrenheit temperatures, wherein the selected temperatures are all digitally displayed on digital interface 250. Thereafter, control box 204 preferably activates second pressure control valve 118, second air volume control valve 120, third air volume control valve 122, fourth air volume control valve 124 and fifth air volume control valve 126 via wires 118*a*, 120*a*, 122*a*, 124*a* and 126*a*, respectively, to open and release into common log manifold 88 the appropriate fractional amounts of secondary dry air 76 so as to permit the mixing thereof with the uniform temperatured tertiary dry air 84, thus producing the user-selected varied/different temperatured resulting air 150 past exits ports 90, 92, 94 and 96.

During production of varied/different temperatured airs, tertiary dry air 84 is also automatically and constantly produced via air conditioning apparatus 41 and released into common log manifold as described above. Furthermore, the uniform temperature of tertiary dry air 84 is preferably equivalent to the lowest selected temperature cued into graphical user interface 202 (here, 70 degrees Fahrenheit) during selection of the varied/different temperatures past exit ports 90, 92, 94 and 96, thus allowing the lowest temperatured air released past the respective port to mix with tertiary dry air 84 to produce the user-selected lowest temperature. In such a configuration, a user can have essentially any varied/different temperatured resulting air 150 produced and expelled past exit ports 90, 92, 94 and 96.

Referring specifically now to FIG. 4, to ensure that accurately temperatured air is being expelled past each exit port 90, 92, 94 and 96 in accord with the user-selected temperatures, exit ports 90, 92, 94 and 96 further possess thermocouplers 128, 130, 132 and 134, respectively, disposed therein, wherein thermocouplers 128, 130, 132 and 134 are any suitable temperature measurement devices known within the art, and wherein thermocouplers 128, 130, 132 and 134 are preferably in electronic feedback communication with control box 204 via feedback wires 128*a*, 130*a*, 132*a* and 134*a*, respectively, so as to maintain accurate computer control/monitoring of the temperature and/or temperatures of resulting air 150 being expelled at each of exit ports 90, 92, 94 and 96.

Referring specifically now to FIG. 5, graphical user interface 202 of control panel assembly 200 further preferably possesses pre-programmable/pre-set buttons 216, wherein pre-set buttons preferably enable a user to program and/or select a consistent, daily body drying program/regimen to best accommodate that user's particular personal drying desires, wherein the device 10 can be pre-programmed to expel a uniform temperatured air and/or differently temperatured air past each of exit ports 90, 92, 94 and 96. Preferably, to ensure safety and to prevent potential over-heating of device 10, control box 204 preferably possesses a safety power-cutoff mechanism and/or circuit breaker therein for the electronic/power/heat sensing of undesirably high temperatures and/or power surges.

Figure 6:
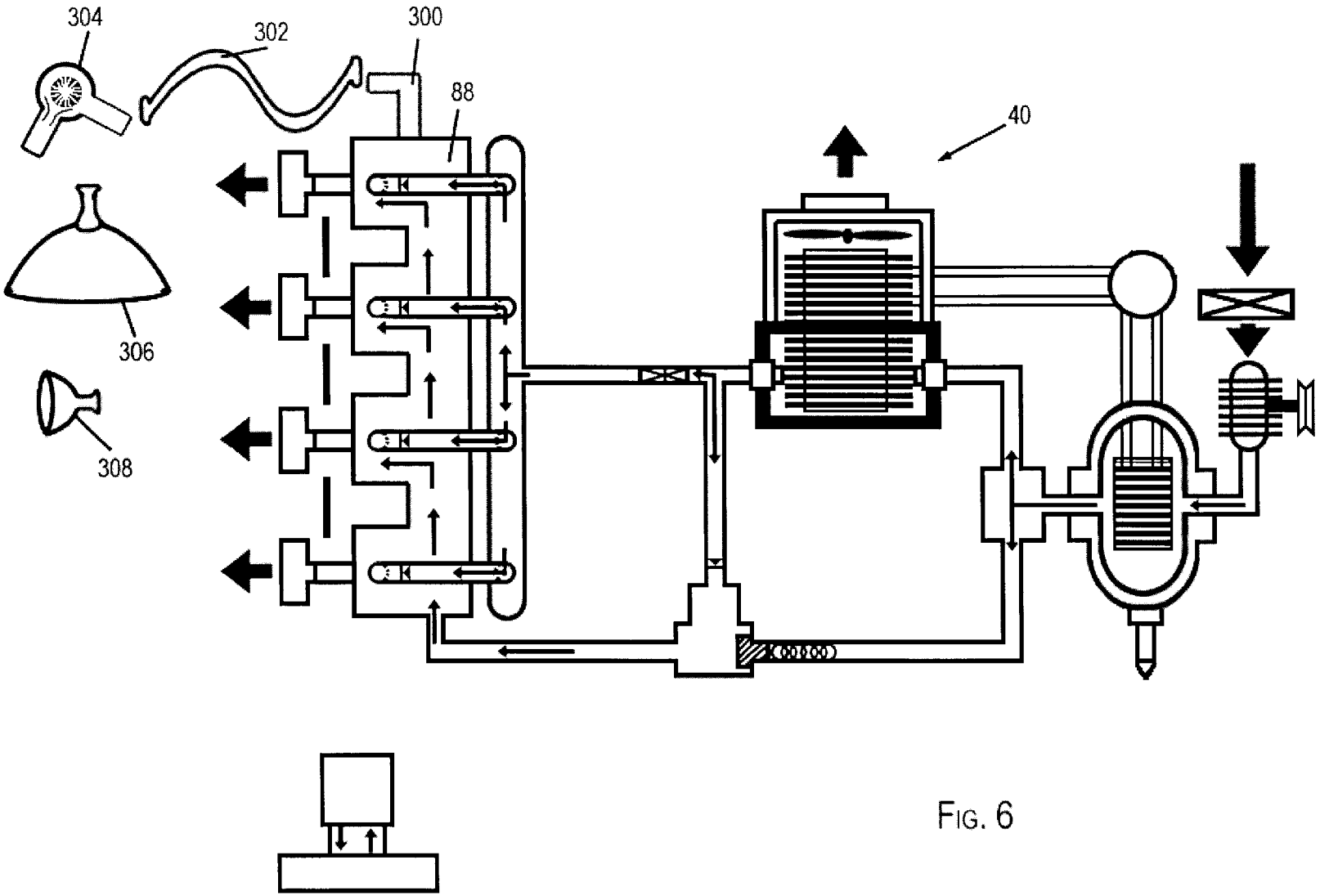
FIG. 6 is a schematic view of a personal dryer according to an alternate embodiment of the present invention.

Referring specifically now to FIG. 6, in an alternate embodiment, it is contemplated that common log manifold 88 could possess an additional exit port 300, wherein port 300 could also expel any temperatured air, and wherein port 300 could receive a tube 302 that could in turn interchangeable receive hairdryer 304 and/or hair helmet 306 for drying a user's hair, and/or nozzle 308 for directing a stream of air at specific body parts.

It is contemplated in an alternate embodiment that exit ports 90, 92, 94 and 96 could further possess electronically/computer controlled air volume restriction valves such as, for exemplary purposes only, solenoid valves, to assist in controlling/restricting the pressure and/or force of the air being expelled past exit ports 90, 92, 94 and 96.

It is contemplated in an alternate embodiment that exit ports 90, 92, 94 and 96 could further possess electronically/computer controlled impellers disposed therein to assist in expelling air past exit ports 90, 92, 94 and 96.

It is contemplated that device 10 could possess floor switches to assist paraplegics in the activation of device 10.

It is contemplated that device 10 could possess any number of exit ports and/or be manufactured to any size to accommodate any facility and/or use.

It is contemplated that device 10 could possess a curtain that would wrap around and encompass a defined area, wherein the curtain could run along appropriately placed rails/guidance tracks.

It is contemplated that device 10 could be utilized to dry personal articles, such as, for exemplary purposes only, wet clothing.

It is contemplated that device 10 could be utilized as a ventilation system.

It is contemplated that device 10 could expel aromatic/scented air.

It is contemplated that device 10 could be configured on any temperature scale such as, for exemplary purposes only, Celsius and/or Kelvin.

It is contemplated that device 10 could be wireless and/or possess a remote thermostat/temperature/flow control mechanism.

It is contemplated that device 10 could possess a control panel activated via remote and/or a control panel having any configuration of buttons, touch pads and/or screens, and could further possess the ability to be incorporated into a computer system with programmable functions and/or activated via disks.

It is contemplated that device 10 could possess a sound buffer and/or barrier.

It is contemplated that device 10 could possess a timer switch.

It is contemplated that device 10 could expel only cold air, or alternatively, only hot air.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A personal dryer, comprising:

means for producing at least one first stream of dry air having a first user-selected temperature;

means for producing at least one second stream of dry air having a second user-selected temperature;

means for programming said first user-selected temperature of said at least one first stream of dry air and said second user-selected temperature of said at least one second stream of dry air; and at least one computer-sensed thermocoupler.

2. The personal dryer of claim 1, wherein said means for programming said first user-selected temperature of said at least one first stream of dry air and said second user-selected temperature of said at least one second stream of dry air is at least one computer control panel.

3. The personal dryer of claim 1, wherein said means for producing said at least one first stream of dry air is at least one compressor with refrigerated dryer, and wherein said means for producing said at least one second stream of dry air is at least one segmented condenser of said at least one compressor with refrigerated dryer.

4. The personal dryer of claim 1, wherein said means for producing said at least one first stream of dry air is at least one air conditioning unit, and wherein said means for producing said at least one second stream of dry air is at least one segmented condenser of said at least one air conditioning unit.

5. The personal dryer of claim 1, further comprising at least one mixing chamber, wherein said at least one first stream of dry air and said at least one second stream of dry air are mixed to create at least one third stream of dry air having a third user-selected temperature.

6. The personal dryer of claim 5, further comprising at least one common log manifold, wherein said at least one second stream of dry air is integrated and mixed with said at least one third stream of dry air to create at least one fourth stream of dry air having a fourth user-selected temperature, and wherein said at least one common log manifold expels said at least one first stream of dry air having said first user-selected temperature, said at least one second stream of dry air having said second user-selected temperature, said at least one third stream of dry air having said third user-selected temperature, and said at least one fourth stream of dry air having said fourth user-selected temperature.

7. The personal dryer of claim 6, wherein said at least one common log manifold expels said at least one first stream of dry air having said first user-selected temperature through a first port, said at least one second stream of dry air having said second user-selected temperature through a second port, said at least one third stream of dry air having said third user-selected temperature through a third port, and said at least one fourth stream of dry air having said fourth user-selected temperature through a fourth port of said at least one common log manifold.

8. The personal dryer of claim 7, further comprising at least one computer-sensed thermocoupler positioned proximate to said ports of said at least one common log manifold.

9. The personal dryer of claim 6, further comprising a plurality of computer controlled pressure control valves and a plurality of computer controlled air volume control valves.

* * * * *